US009208712B2

(12) United States Patent
Hwang et al.

(10) Patent No.: US 9,208,712 B2
(45) Date of Patent: Dec. 8, 2015

(54) METHOD OF DRIVING A DISPLAY PANEL USING SWITCHING ELEMENTS BETWEEN DATA CHANNELS AND DATA LINES AND DISPLAY PANEL DRIVING APPARATUS FOR PERFORMING THE METHOD

(71) Applicant: SAMSUNG DISPLAY CO., LTD., Gyeonggi-do (KR)

(72) Inventors: Hyun-Sik Hwang, Gyeonggi-do (KR); Dae-Gwang Jang, Incheon (KR); Byung-Sun Kim, Seoul (KR); Sang-Mi Kim, Gyeonggi-do (KR); Ji-Myoung Seo, Daegu (KR); Seok-Ha Hong, Gyeonggi-do (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 351 days.

(21) Appl. No.: 13/678,806

(22) Filed: Nov. 16, 2012

(65) Prior Publication Data

US 2014/0015821 A1 Jan. 16, 2014

(30) Foreign Application Priority Data

Jul. 12, 2012 (KR) ..... 10-2012-0075850

(51) Int. Cl.
*G09G 3/36* (2006.01)
*G09G 3/20* (2006.01)

(52) U.S. Cl.
CPC ..... *G09G 3/20* (2013.01); *G09G 3/3688* (2013.01); *G09G 2310/0297* (2013.01)

(58) Field of Classification Search
CPC ..... G09G 3/3611
USPC ..... 345/100
See application file for complete search history.

(56) References Cited

U.S. PATENT DOCUMENTS

| | | | | |
|---|---|---|---|---|
| 6,067,064 | A * | 5/2000 | Furuhashi et al. | 345/89 |
| 8,031,155 | B2 * | 10/2011 | Jeoung et al. | 345/98 |
| 8,427,461 | B2 * | 4/2013 | Lin | 345/205 |
| 8,482,503 | B2 * | 7/2013 | Song et al. | 345/94 |
| 8,681,083 | B2 * | 3/2014 | Kang et al. | 345/97 |
| 8,937,585 | B2 * | 1/2015 | Jang | 345/82 |
| 2003/0001812 | A1 * | 1/2003 | Lee et al. | 345/94 |
| 2004/0189575 | A1 * | 9/2004 | Choi et al. | 345/96 |
| 2006/0103615 | A1 * | 5/2006 | Shih et al. | 345/88 |
| 2006/0109227 | A1 * | 5/2006 | Park | 345/98 |
| 2008/0180372 | A1 * | 7/2008 | Kim et al. | 345/87 |
| 2010/0085348 | A1 | 4/2010 | Bae et al. | |
| 2010/0156954 | A1 * | 6/2010 | Kim et al. | 345/690 |
| 2010/0265238 | A1 | 10/2010 | Lee et al. | |

FOREIGN PATENT DOCUMENTS

KR 1020070109296 A 11/2007

* cited by examiner

*Primary Examiner* — Roy Rabindranath
(74) *Attorney, Agent, or Firm* — F. Chau & Associates, LLC

(57) ABSTRACT

A display panel driving apparatus includes a first switching element and a second switching element. The first switching element applies first pixel data to a first pixel connected with a first data line of a display panel during a first sub frame period. The first switching element is connected with a data channel of a data driving part. The second switching element applies second pixel data having a level higher than a level of the first pixel data to a second pixel connected with a second data line of the display panel during a second sub frame period. The second switching element is connected with the data channel. Thus, display quality of a display apparatus may be enhanced.

16 Claims, 14 Drawing Sheets

METHOD OF DRIVING A DISPLAY PANEL USING SWITCHING ELEMENTS BETWEEN DATA CHANNELS AND DATA LINES AND DISPLAY PANEL DRIVING APPARATUS FOR PERFORMING THE METHOD

CROSS-REFERENCE TO RELATED APPLICATION

This application claims priority under 35 U.S.C. §119 to Korean Patent Application No. 10-2012-0075850, filed on Jul. 12, 2012 in the Korean Intellectual Property Office (KIPO), the contents of which are herein incorporated by reference in their entireties.

TECHNICAL FIELD

Exemplary embodiments of the present invention relate to a method of driving a display panel and a display panel driving apparatus for performing the method, and more particularly to a method of driving a display panel used in a display apparatus and a display panel driving apparatus for performing the method.

DISCUSSION OF THE RELATED ART

A display apparatus, such as a liquid crystal display apparatus, includes a display panel, a gate driving part that outputs gate signals to gate lines of the display panel, and a data driving part that outputs data signals to data lines of the display panel.

A de-multiplexer may be disposed between the data driving part and the data lines to simplify the data driving part. The de-multiplexer selectively connects one channel of the data driving part with one of a plurality of the data lines. For example, the de-multiplexer may include a first switching element disposed between a first channel and a first data line and a second switching element disposed between the first channel and a second data line.

The first switching element and the second switching element are sequentially turned on, and the first pixel connected with the first data line and the second pixel connected with the second data line are sequentially charged with the first pixel data and the second pixel data.

Generally, the capacitance of a data line is higher than the capacitance of a pixel. A gate signal of a gate line connected with the first pixel is activated while the second pixel is charged with the second pixel data after the first pixel is charged with the first pixel. Thus, the first pixel is charged with the first pixel data from the first data line while the second pixel is charged with the second pixel data.

Therefore, a first charge rate at which the first pixel is charged with the first pixel data and a second charge rate at which the second pixel is charged with the second pixel data are different from each other, and thus, the luminance of the first pixel and the luminance of the second pixel are different from each other. Thus, a vertical line may be displayed on the display panel and the display quality of the display apparatus may be degraded.

SUMMARY

According to an exemplary embodiment of the present invention, there is a provided a method of driving a display panel. In the method, first pixel data is applied to a first pixel through a first switching element connected with a data channel of a data driving part during a first sub frame period.

Second pixel data having a voltage level higher than a voltage level of the first pixel data is applied to a second pixel through a second switching element connected with the data channel during a second sub frame period. The first pixel is connected with a first data line of a display panel. The second pixel is connected with a second data line of the display panel.

In an embodiment, the first pixel data may be applied by applying a first turn-on signal to the first switching element, and the second pixel data may be applied by applying a second turn-on signal having a level higher than a level of the first turn-on signal to the second switching element.

In an embodiment, the first pixel data may be applied by applying a third turn-on signal to the first switching element, and the second pixel data may be applied by applying a fourth turn-on signal having a duty ratio higher than a duty ratio of the third turn-on signal to the second switching element.

In an embodiment, the first pixel data may be applied by applying a first image data to the first switching element, and the second pixel data may be applied by applying a second image data having a voltage level higher than a voltage level of the first image data to the second switching element.

In an embodiment, the first pixel and the second pixel respectively may have colors different from each other.

In an embodiment, the first pixel and the second pixel may have substantially the same color.

According to an exemplary embodiment of the present invention, there is a provided a method of driving a display panel. In the method, first pixel data is applied to a first pixel through a first switching element connected with a data channel of a data driving part during a first sub frame period of a first frame period. Second pixel data is applied to a second pixel through a second switching element connected with the data channel during a second sub frame period of the first frame period. The second pixel data is applied to the second pixel through the second switching element during a third sub frame period of a second frame period subsequent to the first frame period. The first pixel data is applied to the first pixel through the first switching element during a fourth sub frame period of the second frame period. The first pixel is connected with a first data line of a display panel. The second pixel is connected with a second data line of the display panel.

In an embodiment, a turn-on sequence of the first switching element and the second switching element may be changed per N (N is a natural number) frames.

In an embodiment, at least one of the first switching element or the second switching element may be turned on per half period of the frame.

In an embodiment, the first pixel and the second pixel may have substantially the same color.

According to an exemplary embodiment of the present invention, a display panel driving apparatus includes a first switching element and a second switching element. The first switching element applies first pixel data to a first pixel connected with a first data line of a display panel during a first sub frame period. The first switching element is connected with a data channel of a data driving part. The second switching element applies second pixel data having a voltage level higher than a voltage level of the first pixel data to a second pixel connected with a second data line of the display panel during a second sub frame period. The second switching element is connected with the data channel.

In an embodiment, the display panel driving apparatus may further include a timing control part applying a first turn-on signal to the first switching element and a second turn-on signal to the second switching element. The second turn-on signal may have a level higher than a level of the first turn-on signal.

In an embodiment, the display panel driving apparatus may further include a timing control part applying a third turn-on signal to the first switching element and a fourth turn-on signal to the second switching element. The fourth turn-on signal may have a duty ratio higher than a duty ratio of the third turn-on signal.

In an embodiment, the data driving part may apply first image data to the first switching element through the data channel and a second image data to the second switching element through the data channel. The second image data may have a voltage level higher than a voltage level of the first image data.

In an embodiment, the first pixel and the second pixel respectively may have colors different from each other.

In an embodiment, the first pixel and the second pixel may have substantially the same color.

According to an exemplary embodiment of the present invention, a display panel driving apparatus includes a first switching element and a second switching element. The first switching element applies first pixel data to a first pixel connected with a first data line of a display panel during a first sub frame period of a first frame period and a fourth sub frame period of a second frame period subsequent to the first frame period. The first switching element is connected with a data channel of a data driving part. The second switching element applies second pixel data to a second pixel connected with a second data line of the display panel during a second sub frame period of the first frame period and a third sub frame period of the second frame period. The second switching element is connected with the data channel. The first frame period subsequently includes the first sub frame period and the second sub frame period, and the second frame period subsequently includes the third sub frame period and the fourth sub frame period.

In an embodiment, a turn-on sequence of the first switching element and the second switching element may be changed per N (N is a natural number) frames.

In an embodiment, at least one of the first switching element or the second switching element may be turned on per half period of the frame.

In an embodiment, the first pixel and the second pixel may have substantially the same color.

According to an embodiment, there is provided a method of driving a display panel, the method including charging a first pixel data voltage to a first pixel via a data channel in response to a first turn-on voltage during a first sub frame period, charging a second pixel data voltage to a second pixel via the data channel in response to a second turn-on voltage during a second sub frame period, and adjusting at least one of a first charging rate at which the first pixel is charged with the first pixel data voltage or a second charging rate at which the second pixel is charged with the second pixel data voltage so that the first charging rate is substantially the same as the second charging rate.

In an embodiment, adjusting at least one of the first charging rate or the second charging rate includes allowing a level of the second turn-on voltage to be higher than a level of the first turn-on voltage.

In an embodiment, adjusting at least one of the first charging rate or the second charging rate includes allowing a duty ratio of the second turn-on voltage to be larger than a duty ratio of the first turn-on voltage.

In an embodiment, adjusting at least one of the first charging rate or the second charging rate includes allowing a level of the second pixel data voltage to be higher than a level of the first pixel data voltage.

According to the embodiments of the present invention, a first charge rate at which a first pixel is charged with a first pixel data through a first switching element of a de-multiplexer and a first data line, and a second charge rate at which a second pixel is charged with a second pixel data through a second switching element of the de-multiplexer and a second data line may be substantially the same as each other. Therefore, a luminance of the first pixel and a luminance of the second pixel may be substantially the same as each other, and thus the display quality of a display apparatus may be enhanced.

BRIEF DESCRIPTION OF THE DRAWINGS

The embodiments of the present invention will become more apparent by the detailed description with reference to the accompanying drawings, in which.

DETAILED DESCRIPTION

Figure 1:
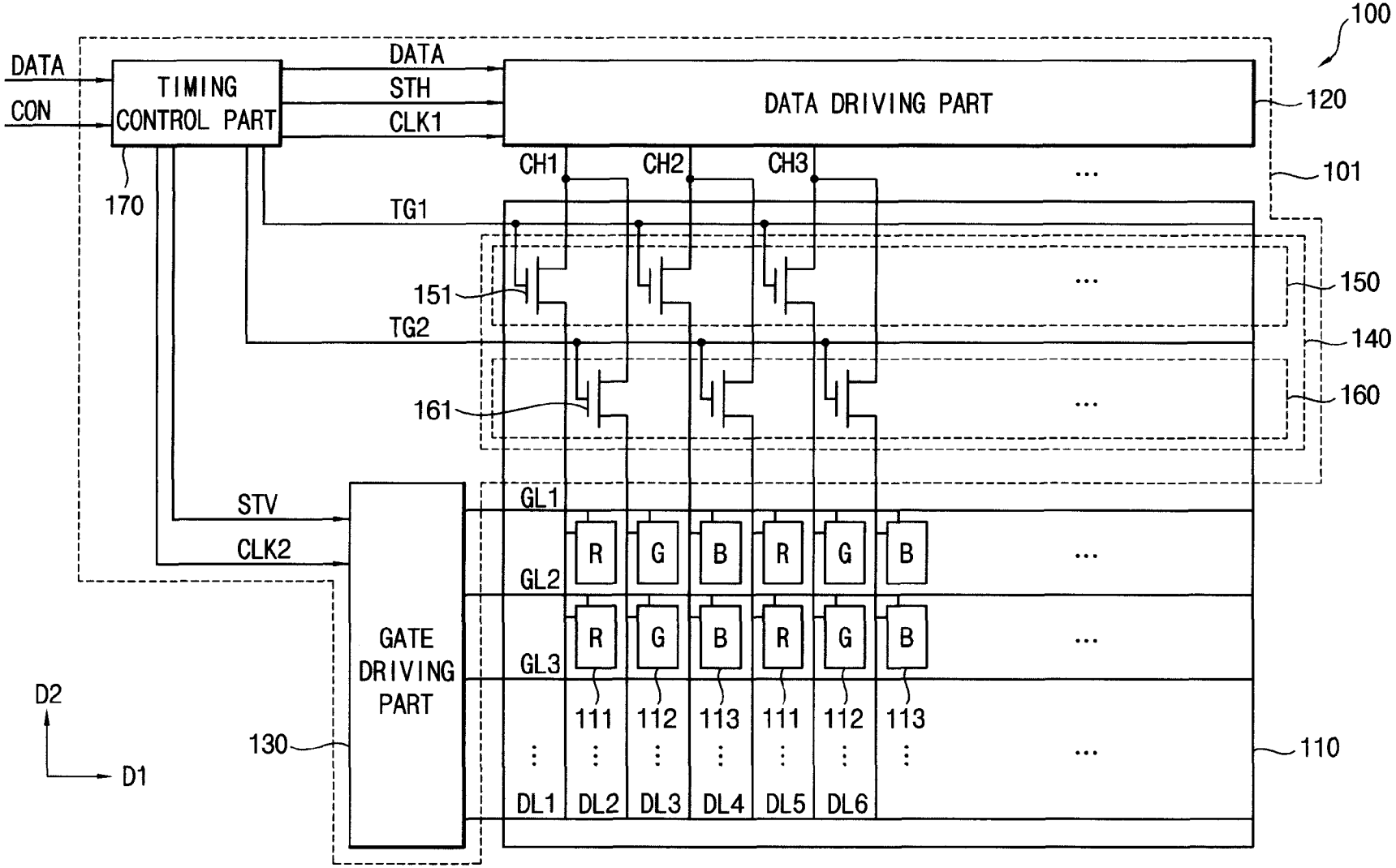
FIG. 1 is a block diagram illustrating a display apparatus according to an exemplary embodiment of the present invention.

Hereinafter, embodiments of the present invention will be described in detail with reference to the accompanying drawings, wherein the same reference numerals may be used to denote the same or substantially the same elements throughout the specification and the drawings. The present invention may be embodied in various different ways and should not be construed as limited to the exemplary embodiments described herein.

It will be understood that when an element or layer is referred to as being "on," "connected to" or "coupled to" another element or layer, it can be directly on, connected or coupled to the other element or layer or intervening elements or layers may be present.

As used herein, the singular forms, "a," "an" and "the" are intended to include the plural forms as well, unless the context clearly indicates otherwise.

FIG. 1 is a block diagram illustrating a display apparatus according to an exemplary embodiment of the present invention.

Referring to FIG. 1, the display apparatus 100 includes a display panel 110 and a display panel driving apparatus 101.

The display panel 110 receives image data DATA to display an image. The display panel 110 includes gate lines GL1, GL2 and GL3 extending in a first direction D1, data lines DL1, DL2, . . . DL6 extending in a second direction D2 substantially perpendicular to the first direction D1, and a plurality of pixels 111, 112 and 113.

The pixels 111, 112 and 113 may include a first pixel 111, a second pixel 112 and a third pixel 113. The first pixel 111 may be a red pixel, the second pixel 112 may be a green pixel 112 and the third pixel 113 may be a blue pixel. The first pixel 111, the second pixel 112 and the third pixel 113 may be disposed sequentially and repeatedly in the first direction D1. For example, according to an embodiment, the display panel 110 may include A*B (A and B are natural numbers) pixels 111, 112 and 113. Each of the pixels 111, 112, and 113 includes a thin-film transistor electrically connected to a corresponding one of the gate lines GL1, GL2 and GL3 and to a corresponding one of the data lines DL1, DL2, . . . DL6, a liquid crystal capacitor and a storage capacitor connected to the thin-film transistor.

The display panel driving apparatus 101 includes a data driving part 120, a gate driving part 130, a de-multiplexer 140 and a timing control part 170.

The data driving part 120 outputs the image data DATA to the data lines DL1, DL2, DL6 through a plurality of channels CH1 and CH2 in response to a horizontal start signal STH and a first clock signal CLK1 provided from the timing control part 170.

The gate driving part 130 generates gate signals using a vertical start signal STV and a second clock signal SLK2 provided from the timing control part 170 and outputs the gate signals to the gate lines GL1, GL2 and GL3. The gate driving part 130 may be disposed at two opposite sides of the display panel 110. For example, according to an embodiment, the gate driving part 130 may be disposed at a first peripheral area adjacent to first terminals of the gate lines GL1, GL2 and GL3 and a second peripheral area adjacent to second terminals of the gate lines GL1, GL2 and GL3. According to an embodiment, the gate driving part 130 may include an oxide silicon gate (OSG) or an amorphous silicon gate (ASG). According to an embodiment, the gate driving part 130 may be disposed on the display panel 110.

The de-multiplexer 140 is disposed between the data driving part 120 and the data lines DL1, DL2, . . . DL6, and the de-multiplexer 140 selectively connects each of the channels CH1 and CH2 with corresponding one or more data lines of the data lines DL1, DL2, . . . DL6. For example, according to an embodiment, the de-multiplexer 140 may selectively connect one of the channels CH1 and CH2 with two of the data lines DL1, DL2, . . . DL6. Alternatively, the de-multiplexer 140 may selectively connect one of the channels CH1 and CH2 with three of the data lines DL1, DL2, . . . DL6.

When the de-multiplexer 140 connects one of the channels CH1 and CH2 with two of the data lines DL1, DL2, . . . DL6, the de-multiplexer 140 includes a first switching element part 150 and a second switching element part 160.

The first switching element part 150 includes first switching elements 151 and connects the channels CH1 and CH2 with odd-numbered data lines DL1, DL3 and DL5 of the data lines DL1, DL2, . . . DL6. The second switching element part 160 includes second switching elements 161 and connects the channels CH1 and CH2 with even-numbered data lines DL2, DL4 and DL6 of the data lines DL1, DL2, . . . DL6. For example, according to an embodiment, a first switching element 151 of the first switching element part 150 may connect a first channel CH1 with a first data line DL1, and a second switching element 161 of the second switching element part 160 may connect the first channel CH1 with a second data line DL2.

The first switching element 151 and the second switching element 161 connected with one of the channels CH1 and CH2 may be connected with respective corresponding pixels having different colors among the pixels 111, 112 and 113. For example, according to an embodiment, the first switching element 151 may be connected with the first data line DL1 connected with the first pixel 111, and the second switching element 161 may be connected with the second data line DL2 connected with the second pixel 112. Alternatively, the first switching element 151 and the second switching element 161 connected with one of the channels CH1 and CH2 may be connected with respective corresponding pixels having the same color among the pixels 111, 112 and 113. For example, according to an embodiment, the first switching element 151 may be connected with the first data line DL1 connected with the first pixel 111, and the second switching element 161 may be connected with a fourth data line DL4 connected with the first pixel 111.

In an exemplary embodiment, the second data line DL2 is adjacent to the first data line DL1, but it is not limited thereto. For example, according to an embodiment, the second data line DL2 is spaced apart from the second first data line DL1, and thus at least one data line may be disposed between the first data line DL1 and the second data line DL2.

The timing control part 170 receives the image data DATA and a control signal CON from an outside source. The control signal CON may include a horizontal synchronous signal Hsync, a vertical synchronous signal Vsync and a clock signal.

The timing control part 170 generates the horizontal start signal STH using the horizontal synchronous signal Hsync and outputs the horizontal start signal STH to the data driving part 120. The timing control part 170 generates the vertical start signal STV using the vertical synchronous signal Vsync and outputs the vertical start signal STV to the gate driving part 130. The timing control part 170 generates the first clock signal CLK1 and the second clock signal CLK2 using the clock signal and outputs the first clock signal CLK1 to the data driving part 120 and the second clock signal CLK2 to the gate driving part 130.

The timing control part 170 outputs a first turn-on signal TG1 turning on the first switching element 151 of the de-multiplexer 140 to the first switching element 151 and a second turn-on signal TG2 turning on the second switching element 161 of the de-multiplexer 140 to the second switching element 161. The first turn-on signal TG1 and the second turn-on signal TG2 may be de-multiplexer control signals controlling the first switching element 151 and the second switching element 161 of the de-multiplexer 140.

Figure 2:
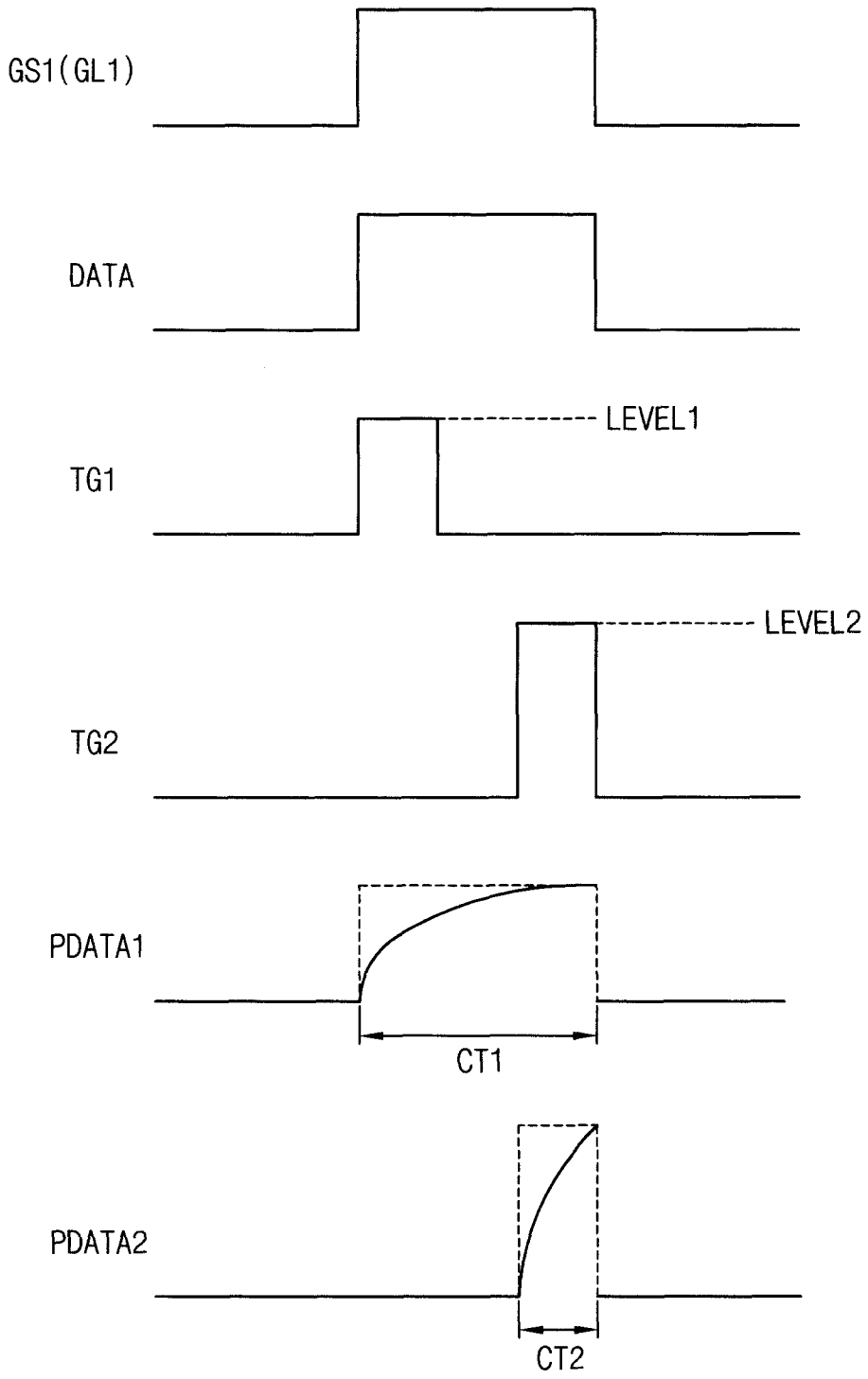
FIG. 2 is a waveform diagram illustrating a first gate signal applied to the first gate line, image data, a first turn-on signal, a second turn-on signal, first pixel data applied to the first pixel and second pixel data applied to the second pixel of FIG. 1.

FIG. 2 is a waveform diagram illustrating a first gate signal GS1 applied to the first gate line GL1, the image data DATA, the first turn-on signal TG1, the second turn-on signal TG2, first pixel data applied to the first pixel 111 and second pixel data applied to the second pixel 112 of FIG. 1.

Referring to FIGS. 1 and 2, the timing control part 170 sequentially outputs the first turn-on signal TG1 and the second turn-on signal TG2. The first switching element 151 is turned on by the first turn-on signal TG1 during a first sub frame period, and the first pixel data PDATA1 is applied to the first pixel 111 by turning on the first switching element 151. The second switching element 161 is turned on by the second turn-on signal TG2 during a second sub frame period subsequent to the first sub frame period, and the second pixel data PDATA2 is applied to the second pixel 112 by turning on the second switching element 161.

The second switching element 161 is turned on after the first switching element 151 is turned on, and thus a first charge rate at which the first pixel 111 is charged with the first pixel data PDATA1 is higher than a second charge rate at which the second pixel 112 is charged with the second pixel data PDATA2 since a first charge time CT1 during which the first pixel 111 is charged with the first pixel data PDATA1 is longer than a second charge time CT2 during which the second pixel 112 is charged with the second pixel data PDATA2 while the first gate signal GS1 is applied to the first gate line GL1 connected to the first pixel 111 and the second pixel 112, when a level of the first turn-on signal TG1 and a level of the second turn-on signal TG2 are substantially the same as each other and a duty ratio of the first turn-on signal TG1 and a duty ratio of the second turn-on signal TG2 are substantially the same as each other. Thus, a luminance of the first pixel 111 is higher than a luminance of the second pixel 112.

The timing control part 170 controls the first turn-on signal TG1 and the second turn-on signal TG2 so that the level of the second turn-on signal TG2 turning on the second switching element 161 is higher than the level of the first turn-on signal TG1 turning on the first switching element 151 to decrease a difference between the first charge rate and the second charge rate. The first turn-on signal TG1 has a first level LEVEL1 and the second turn-on signal TG2 has a second level LEVEL2 higher than the first level LEVEL1, and thus a voltage level of the second pixel data PDATA2 applied to the second pixel 112 is higher than a voltage level of the first pixel data PDATA1 applied to the first pixel 111.

Figure 3:
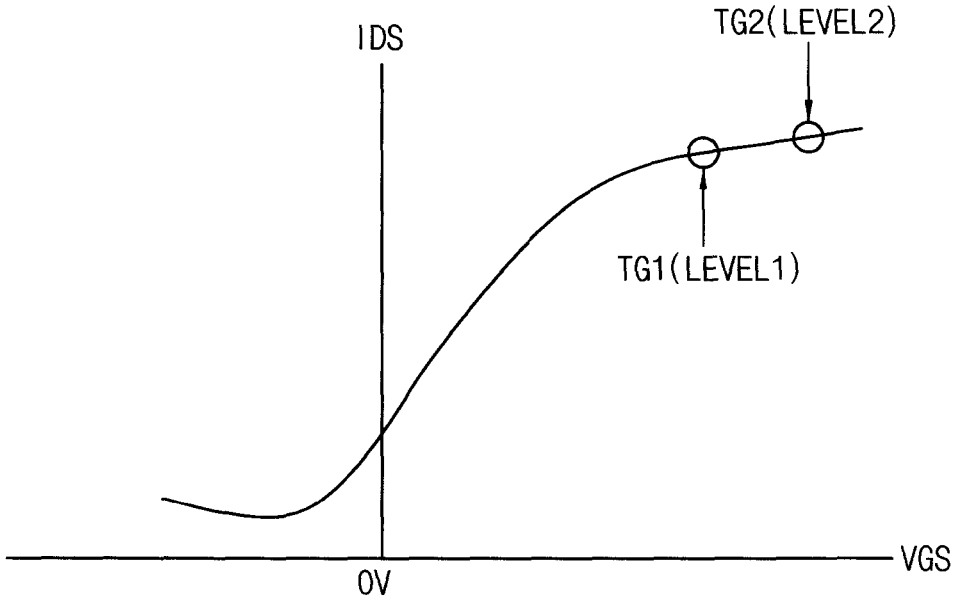
FIG. 3 is a graph illustrating a level of the first turn-on signal and a level of the second turn-on signal of FIG. 1.

FIG. 3 is a graph illustrating a level of the first turn-on signal TG1 and a level of the second turn-on signal TG2 of FIG. 1.

Referring to FIGS. 1 to 3, the first turn-on signal TG1 has the first level LEVEL1 and the second turn-on signal TG2 has the second level LEVEL2 higher than the first level LEVEL1. Therefore, the voltage level of the second pixel data PDATA2 applied to the second pixel 112 is higher than the voltage level of the first pixel data PDATA1 applied to the first pixel 111. Thus, the first charge rate and the second charge rate may be substantially the same as each other although the first charge time CT1 during which the first pixel 111 is charged with the first pixel data PDATA1 is longer than the second charge time CT2 during which the second pixel 112 is charged with the second pixel data PDATA2.

Figure 4:
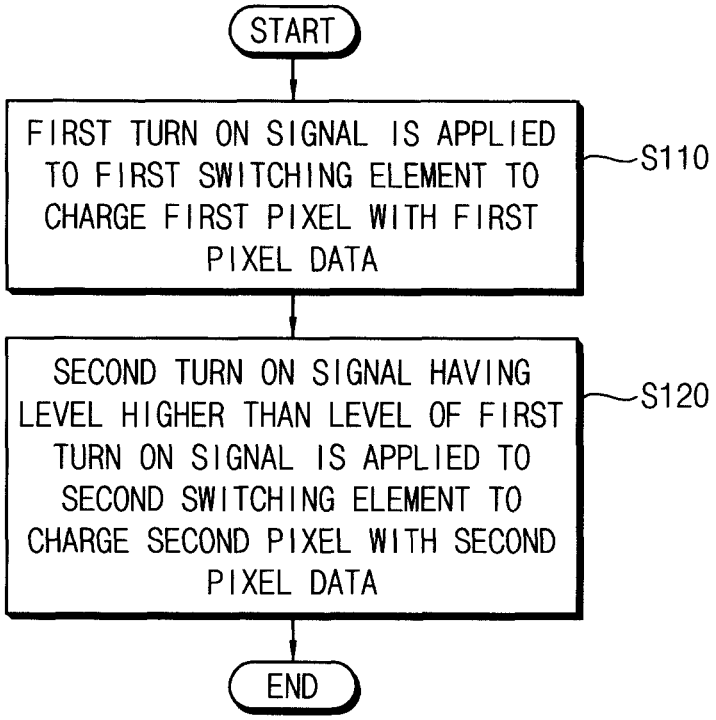
FIG. 4 is a flowchart illustrating a method of driving a display panel by the display panel driving apparatus of FIG. 1.

FIG. 4 is a flowchart illustrating a method of driving a display panel by the display panel driving apparatus 101 of FIG. 1.

Referring to FIGS. 1 to 4, the timing control part 170 applies the first turn-on signal TG1 to the first switching element 151 to turn on the first switching element 151, and the first pixel data PDATA1 is charged to the first pixel 111 by turning on the first switching element 151 (step S110). The first switching element 151 is turned on and the first pixel data PDATA1 is applied to the first pixel 111 during the first sub frame period. The first turn-on signal TG1 has the first level LEVEL1.

The timing control part 170 applies the second turn-on signal TG2 to the second switching element 161 to turn on the second switching element 161, and the second pixel data PDATA2 is charged to the second pixel 112 by turning on the second switching element 161 (step S120). The second switching element 161 is turned on and the second pixel data PDATA2 is applied to the second pixel 112 during the second sub frame period subsequent to the first sub frame period. The second turn-on signal TG2 has the second level LEVEL2 higher than the first level LEVEL1.

The first turn-on signal TG 1 has the first level LEVEL1, the second turn-on signal TG2 has the second level LEVEL2 higher than the first level LEVEL1, and thus the voltage level of the second pixel data PDATA2 applied to the second pixel 112 is higher than the voltage level of the first pixel data PDATA1 applied to the first pixel 111. Thus, the first charge rate and the second charge rate may be substantially the same as each other although the first charge time CT1 during which the first pixel 111 is charged with the first pixel data PDATA1 is longer than the second charge time CT2 during which the second pixel 112 is charged with the second pixel data PDATA2.

According to an exemplary embodiment, the first charge rate at which the first pixel 111 is charged with the first pixel data PDATA1 and the second charge rate at which the second pixel 112 is charged with the second pixel data PDAT2 may be substantially the same as each other by controlling the level of the first turn-on signal TG1 turning on the first switching element 151 and the level of the second turn-on signal TG2 turning on the second switching element 161 although the first charge time CT1 during which the first pixel 111 is charged with the first pixel data PDATA1 through the first switching element 151 and the first data line DL 1 and the second charge time CT2 during which the second pixel 112 is charged with the second pixel data PDATA2 through the second switching element 161 and the second data line DL2 are substantially different from each other.

Figure 5:
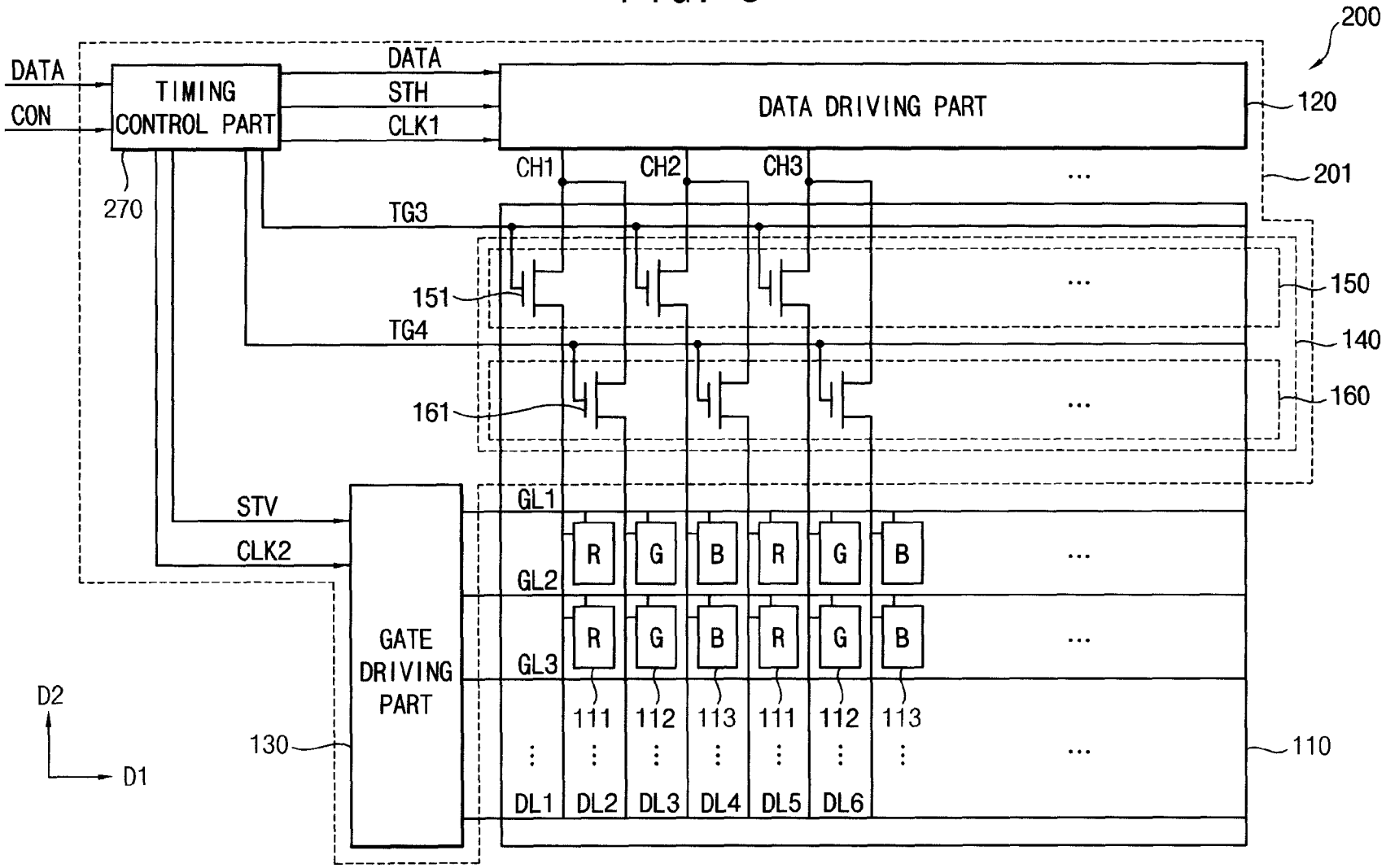
FIG. 5 is a block diagram illustrating a display apparatus according to an exemplary embodiment of the present invention.

FIG. 5 is a block diagram illustrating a display apparatus according to an exemplary embodiment of the present invention.

The display apparatus 200 according to an exemplary embodiment is substantially the same as the display apparatus 100 described above in connection with FIG. 1 except for a display panel driving apparatus 201 and a timing control part 270.

Referring to FIG. 5, the display panel driving apparatus 201 includes the data driving part 120, the gate driving part 130, the de-multiplexer 140 and the timing control part 270.

The timing control part 270 outputs a third turn-on signal TG3 turning on the first switching element 151 of the de-multiplexer 140 to the first switching element 151 and a fourth turn-on signal TG4 turning on the second switching element 161 of the de-multiplexer 140 to the second switching element 161. The third turn-on signal TG3 and the fourth turn-on signal TG4 may be de-multiplexer control signals controlling the first switching element 151 and the second switching element 161 of the de-multiplexer 140.

Figure 6:
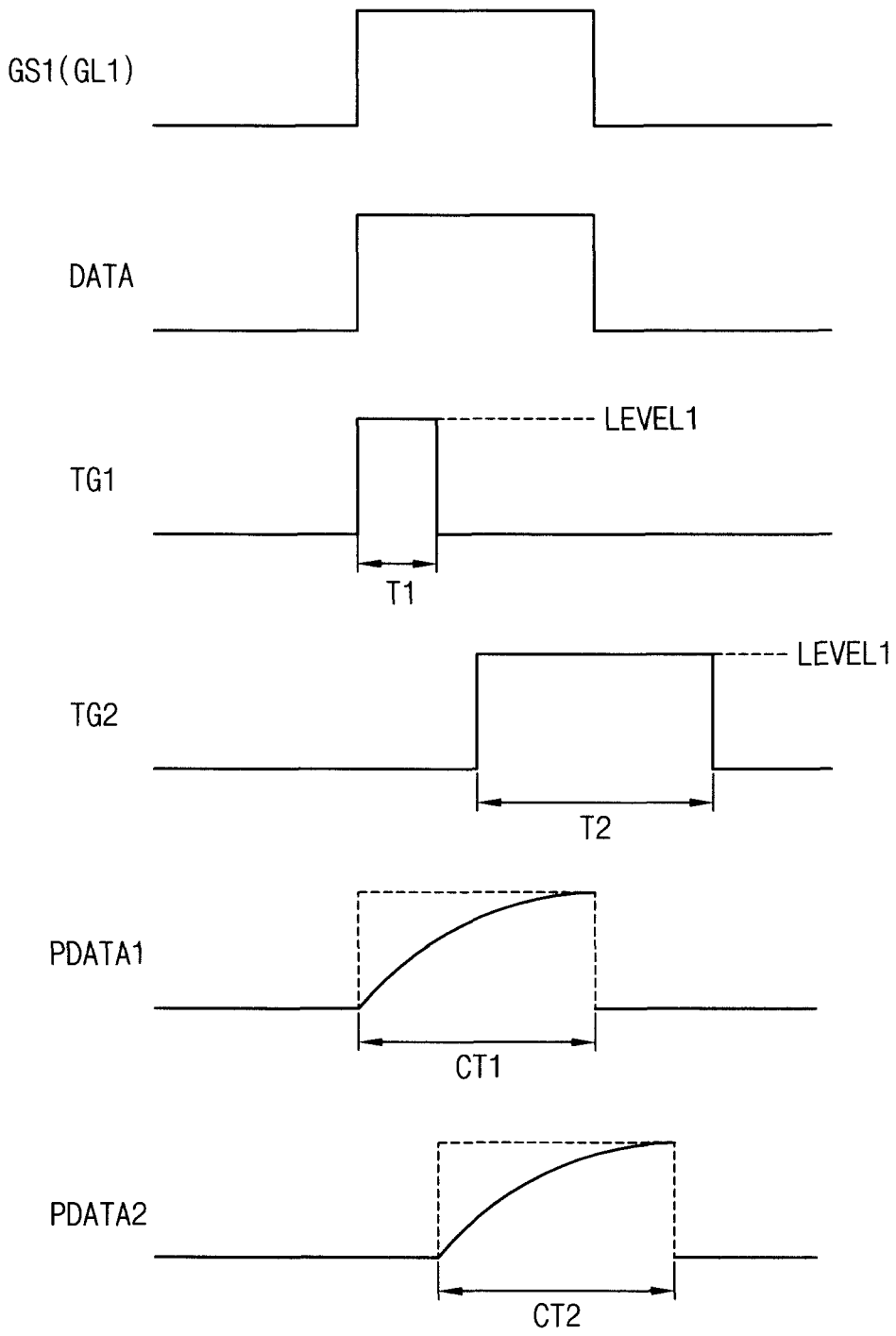
FIG. 6 is a waveform diagram illustrating a first gate signal applied to the first gate line, image data, a third turn-on signal, a fourth turn-on signal, first pixel data applied to the first pixel and second pixel data applied to the second pixel of FIG. 5.

FIG. 6 is a waveform diagram illustrating the first gate signal applied to the first gate line GL1, the image data DATA, the third turn-on signal TG3, the fourth turn-on signal TG4, first pixel data applied to the first pixel 111 and second pixel data applied to the second pixel 112 of FIG. 5.

Referring to FIGS. 5 and 6, the timing control part 270 sequentially outputs the third turn-on signal TG3 and the fourth turn-on signal TG4. The first switching element 151 is turned on by the third turn-on signal TG3 during a first sub frame period, and the first pixel data PDATA1 is applied to the first pixel 111 by turning on the first switching element 151. The second switching element 161 is turned on by the fourth turn-on signal TG4 during a second sub frame period subsequent to the first sub frame period, and the second pixel data PDATA2 is applied to the second pixel 112 by turning on the second switching element 161.

The second switching element 161 is turned on after the first switching element 151 is turned on, and thus a first charge rate at which the first pixel 111 is charged with the first pixel data PDATA1 is higher than a second charge rate at which the second pixel 112 is charged with the second pixel data PDATA2 since a first charge time CT1 during which the first pixel 111 is charged with the first pixel data PDATA1 is longer than a second charge time CT2 during which the second pixel 112 is charged with the second pixel data PDATA2 while the first gate signal GS1 is applied to the first gate line GL 1 connected to the first pixel 111 and the second pixel 112, when a level of the third turn-on signal TG3 and a level of the fourth turn-on signal TG4 are substantially the same as each other and a duty ratio of the third turn-on signal TG3 and a duty ratio of the fourth turn-on signal TG4 are substantially the same as each other. Thus, a luminance of the first pixel 111 is higher than a luminance of the second pixel 112.

The timing control part 270 controls the third turn-on signal TG3 and the fourth turn-on signal TG4 so that the duty ratio of the fourth turn-on signal TG4 turning on the second switching element 161 is higher than the duty ratio of the third turn-on signal TG3 turning on the first switching element 151 to decrease a difference between the first charge rate and the second charge rate. Therefore, the third turn-on signal TG3 has a first duty ratio T1, the fourth turn-on signal TG4 has a second duty ratio T2 higher than the first duty ratio T1, and thus the first charge time CT1 during which the first pixel 111 is charged with the first pixel data PDATA1 and the second charge time CT2 during which the second pixel 112 is charged with the second pixel data PDATA2 may be substantially the same as each other. Thus, the first charge rate and the second charge rate may be substantially the same as each other.

Figure 7:
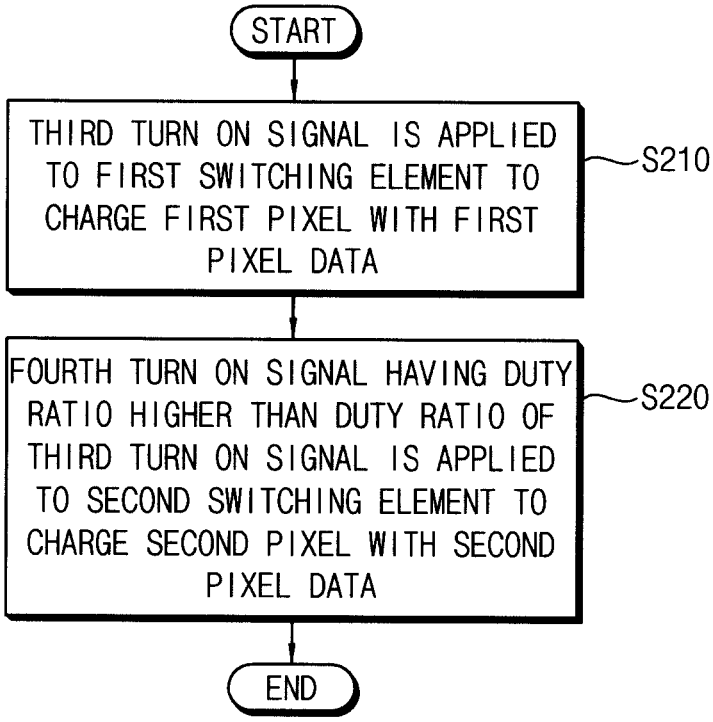
FIG. 7 is a flowchart illustrating a method of driving a display panel by the display panel driving apparatus of FIG. 5.

FIG. 7 is a flowchart illustrating a method of driving a display panel by the display panel driving apparatus 201 of FIG. 5.

Referring to FIGS. 5 to 7, the timing control part 270 applies the third turn-on signal TG3 to the first switching element 151 to turn on the first switching element 151, and the first pixel data PDATA1 is charged to the first pixel 111 by turning on the first switching element 151 (step S210). The first switching element 151 is turned on and the first pixel data PDATA1 is applied to the first pixel 111 during the first sub frame period. The third turn-on signal TG3 has the first duty ratio T1.

The timing control part 270 applies the fourth turn-on signal TG4 to the second switching element 161 to turn on the second switching element 161, and the second pixel data PDATA2 is charged to the second pixel 112 by turning on the second switching element 161 (step S220). The second switching element 161 is turned on and the second pixel data PDATA2 is applied to the second pixel 112 during the second sub frame period subsequent to the first sub frame period. The fourth turn-on signal TG4 has the second duty ratio T2 higher than the first duty ratio T1.

The third turn-on signal TG3 has the first duty ratio T1, the fourth turn-on signal TG4 has the second duty ratio T2 higher than the first duty ratio T1, and thus the first charge time CT1 during which the first pixel 111 is charged with the first pixel data PDATA1 and the second charge time CT2 during which the second pixel 112 is charged with the second pixel data PDATA2 may be substantially the same as each other. Thus, the first charge rate and the second charge rate may be substantially the same as each other.

According to an exemplary embodiment, the first charge rate at which the first pixel 111 is charged with the first pixel data PDATA1 and the second charge rate at which the second pixel 112 is charged with the second pixel data PDAT2 may be substantially the same as each other by controlling the duty ratio of the third turn-on signal TG3 turning on the first switching element 151 and the duty ratio of the fourth turn-on signal TG4 turning on the second switching element 161.

Figure 8:
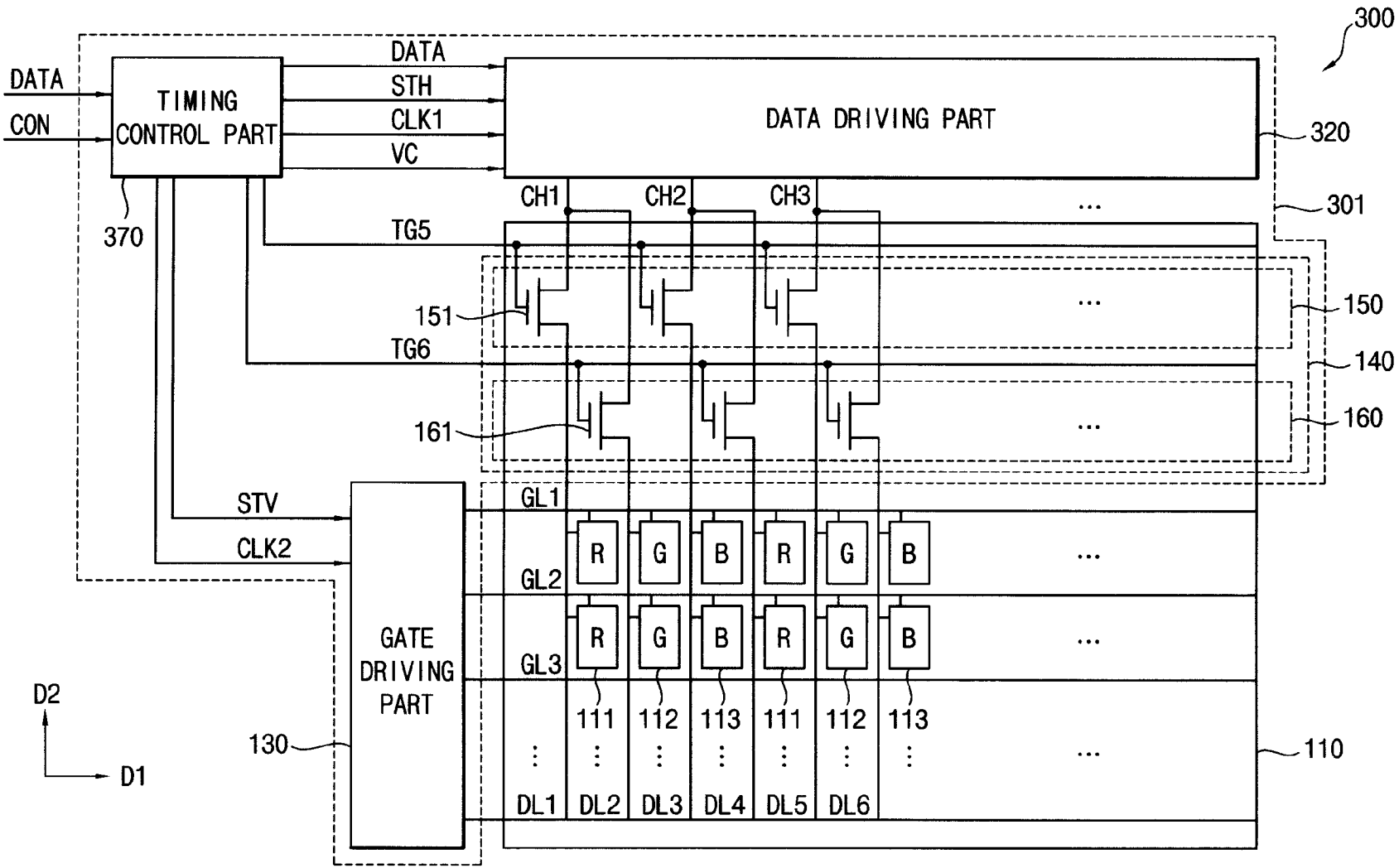
FIG. 8 is a block diagram illustrating a display apparatus according to an exemplary embodiment of the present invention.

FIG. 8 is a block diagram illustrating a display apparatus according to an exemplary embodiment of the present invention.

The display apparatus 300 according to an exemplary embodiment is substantially the same as the display apparatus 100 described in connection with FIG. 1 except for a display panel driving apparatus 301, a data driving part 320 and a timing control part 370.

Referring to FIG. 8, the display apparatus 300 includes the display panel 110 and the display panel driving apparatus 301.

The display panel driving apparatus 301 includes the data driving part 320, the gate driving part 130, the de-multiplexer 140 and the timing control part 370.

The timing control part 370 outputs a fifth turn-on signal TG5 turning on the first switching element 151 of the de-multiplexer 140 to the first switching element 151 and a sixth turn-on signal TG6 turning on the second switching element 161 of the de-multiplexer 140 to the second switching element 161.

Figure 9:
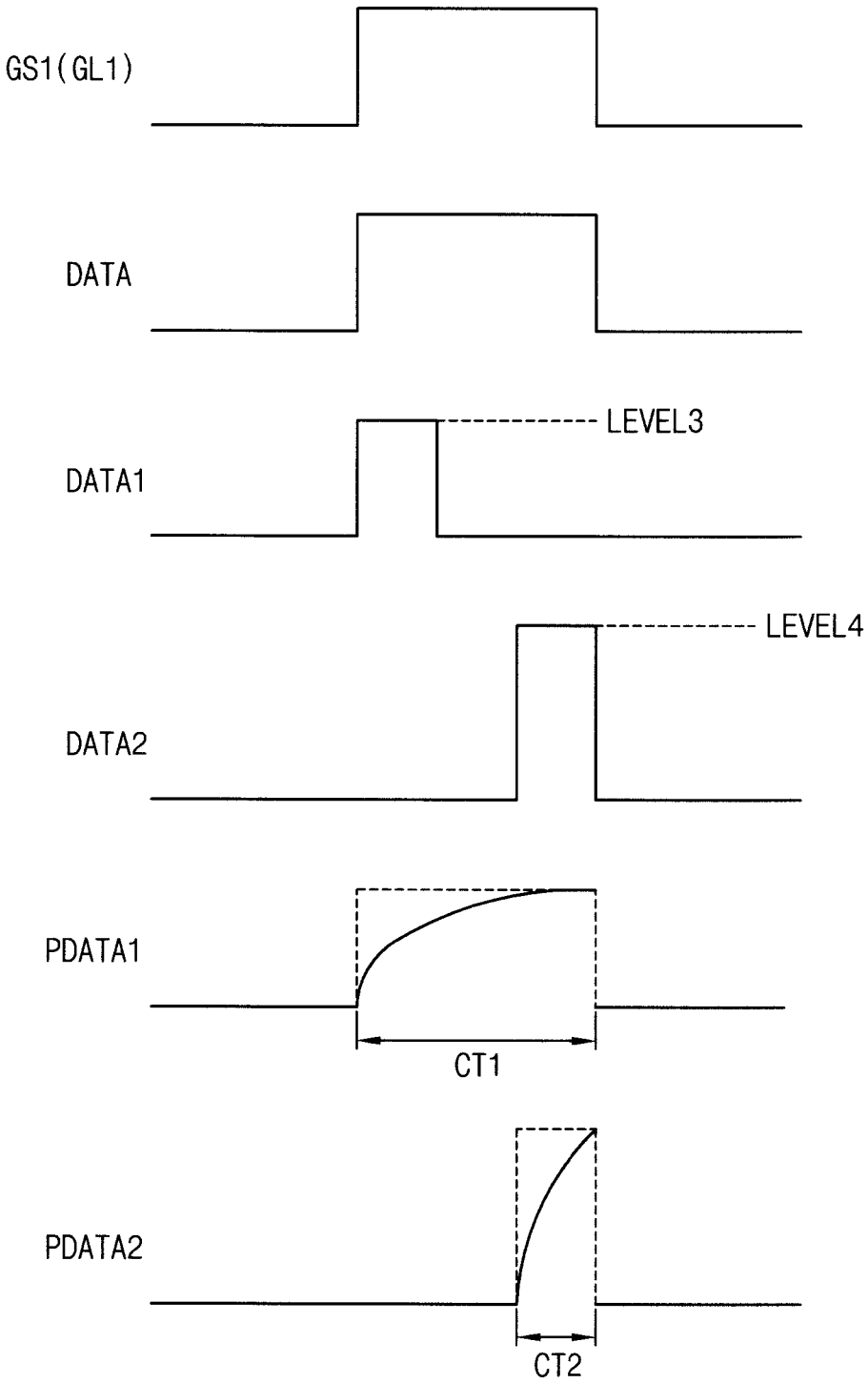
FIG. 9 is a waveform diagram illustrating a first gate signal applied to the first gate line, image data, first image data applied to the first switching element, second image data applied to the second switching element, first pixel data applied to the first pixel and second pixel data applied to the second pixel of FIG. 8.

FIG. 9 is a waveform diagram illustrating the first gate signal applied to the first gate line GL1, the image data DATA, first image data applied to the first switching element 151, second image data applied to the second switching element 161, first pixel data applied to the first pixel 111 and second pixel data applied to the second pixel 112 of FIG. 8.

Referring to FIGS. 8 and 9, the timing control part 370 sequentially outputs the fifth turn-on signal TG5 and the sixth turn-on signal TG6. The first switching element 151 is turned on by the fifth turn-on signal TG5 during a first sub frame period, and the first pixel data PDATA1 is applied to the first pixel 111 by turning on the first switching element 151. The second switching element 161 is turned on by the sixth turn-on signal TG6 during a second sub frame period subsequent to the first sub frame period, and the second pixel data PDATA2 is applied to the second pixel 112 by turning on the second switching element 161.

The second switching element 161 is turned on after the first switching element 151 is turned on, and thus a first charge rate at which the first pixel 111 is charged with the first pixel data PDATA1 is higher than a second charge rate at which the second pixel 112 is charged with the second pixel data PDATA2 since a first charge time CT1 during which the first pixel 111 is charged with the first pixel data PDATA1 is longer than a second charge time CT2 during which the second pixel 112 is charged with the second pixel data PDATA2 while the first gate signal GS1 is applied to the first gate line GL 1 connected to the first pixel 111 and the second pixel 112, when a level of the third turn-on signal TG3 and a level of the fourth turn-on signal TG4 are substantially the same as the same and a duty ratio of the third turn-on signal TG3 and a duty ratio of the fourth turn-on signal TG4 are substantially the same as the same. Thus, a luminance of the first pixel 111 is higher than a luminance of the second pixel 112.

The timing control part 370 outputs a voltage control signal VC to the data driving part 320 so that a voltage level of the second image data DATA2 applied to the second switching element 161 from the data driving part 320 is higher than a voltage level of the first image data DATA1 applied to the first switching element 151 from the data driving part 320 to decrease a difference between the first charge rate and the second charge rate.

The data driving part 320 controls the first image data DATA1 applied to the first switching element 151 and the second image data DATA2 applied to the second switching element 161 so that the voltage level of the second image data DATA2 is higher than the voltage level of the first image data DATA1. Therefore, the first image data DATA1 has a third voltage level LEVEL3, the second image data DATA2 has a fourth voltage level LEVEL4, and thus a voltage level of the second pixel data PDATA2 applied to the second pixel 112 is higher than a voltage level of the first pixel data PDATA1 applied to the first pixel 111.

The first charge rate and the second charge rate may be substantially the same as each other although the first charge time CT1 during which the first pixel 111 is charged with the first pixel data PDATA1 is longer than the second charge time CT2 during which the second pixel 112 is charged with the second pixel data PDATA2.

Figure 10:
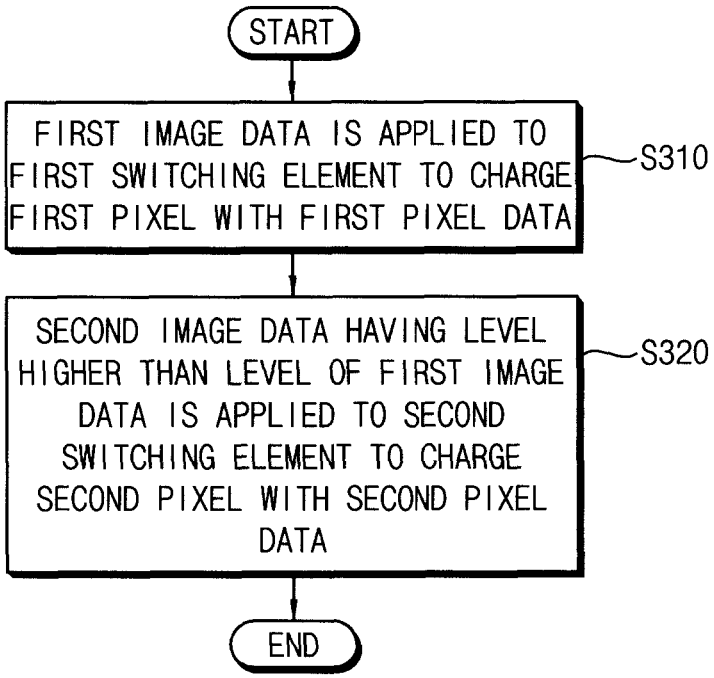
FIG. 10 is a flowchart illustrating a method of driving a display panel by the display panel driving apparatus of FIG. 8.

FIG. 10 is a flowchart illustrating a method of driving a display panel by the display panel driving apparatus 301 of FIG. 8.

Referring to FIGS. 8 to 10, the timing control part 370 applies the fifth turn-on signal TG5 to the first switching element 151 to turn on the first switching element 151, the data driving part 320 applies the first image data DATA1 to the first switching element 151, and the first pixel data PDATA1 is charged to the first pixel 111 by turning on the first switching element 151 (step S310). The first switching element 151 is turned on and the first pixel data PDATA1 is applied to the first pixel 111 during the first sub frame period.

The timing control part 370 applies the sixth turn-on signal TG6 to the second switching element 161 to turn on the second switching element 161, the data driving part 320 applies the second image data DATA2 to the second switching element 161, and the second pixel data PDATA2 is charged to the second pixel 112 by turning on the second switching element 161 (step S320). The second switching element 161 is turned on and the second pixel data PDATA2 is applied to the second pixel 112 during the second sub frame period subsequent to the first sub frame period. The voltage level of the second pixel data PDATA2 is higher than the voltage level of the first pixel data PDATA1.

The voltage level of the second image data DATA2 is higher than the voltage level of the first image data DATA1, and thus the voltage level of the second pixel data DATA2 applied to the second pixel 112 is higher than the voltage level of the first pixel data PDATA1 applied to the first pixel 111. Thus, the first charge rate and the second charge rate may be substantially the same as each other although the first charge time CT1 during which the first pixel 111 is charged with the first pixel data PDATA1 is longer than the second charge time CT2 during which the second pixel 112 is charged with the second pixel data PDATA2.

According to an exemplary embodiment, the first charge rate at which the first pixel 111 is charged with the first pixel data PDATA1 and the second charge rate at which the second pixel 112 is charged with the second pixel data PDAT2 may be substantially the same as each other by controlling the voltage level of the first image data DATA1 applied to the first switching element 151 and the voltage level of the second image data DATA2 applied to the second switching element 161 although the first charge time CT1 during which the first pixel 111 is charged with the first pixel data PDATA1 through the first switching element 151 and the first data line DL1 and the second charge time CT2 during which the second pixel 112 is charged with the second pixel data PDATA2 through the second switching element 161 and the second data line DL2 are different from each other.

Figure 11:
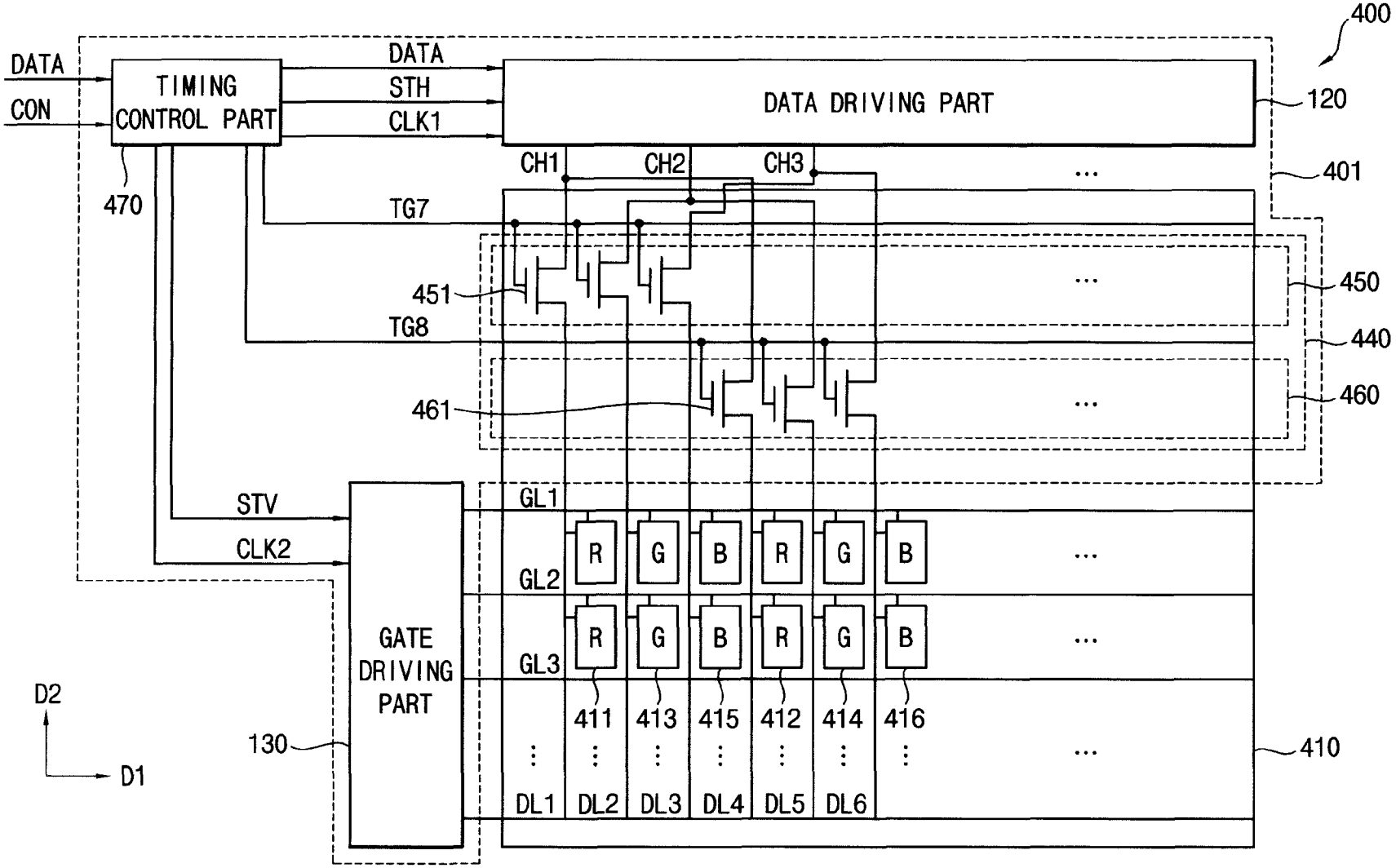
FIG. 11 is a block diagram illustrating a display apparatus according to an exemplary embodiment of the present invention.

FIG. 11 is a block diagram illustrating a display apparatus according to an exemplary embodiment of the present invention.

The display apparatus 400 according to an exemplary embodiment is substantially the same as the display apparatus 100 described above in connection with FIG. 1 except for a display panel 410, a display panel driving apparatus 401, a de-multiplexer 440 and a timing control part 470.

Referring to FIG. 11, the display apparatus 400 includes the display panel 410 and the display panel driving apparatus 401.

The display panel 410 receives image data DATA to display an image. The display panel 410 includes gate lines GL1, GL2 and GL3 extending in a first direction D1, data lines DL1, DL2, . . . DL6 extending in a second direction D2 substantially perpendicular to the first direction D1, and a plurality of pixels 411, 412, 413, 414, 415 and 416.

The pixels 411, 412, 413, 414, 415 and 416 may include a first pixel 411, a second pixel 412, a third pixel 413, a fourth pixel 414, a fifth pixel 415 and a sixth pixel 416, and each of the first pixel 411 and the second pixel 412 may be a red pixel, each of the third pixel 413 and the fourth pixel 414 may be a green pixel and each of the fifth pixel 415 and the sixth pixel 416 may be a blue pixel. The first pixel 411, the third pixel 413 and the fifth pixel 415 may be disposed sequentially and repeatedly in the first direction D1, and the second pixel 412, the fourth pixel 414 and the sixth pixel 416 may be disposed sequentially and repeatedly in the first direction D1. The first pixel 411 and the second pixel 412 may be spaced apart from each other, the third pixel 413 and the fourth pixel may be spaced apart from each other, and the fifth pixel 415 and the sixth pixel 416 may be spaced apart from each other.

The display panel driving apparatus 401 includes the data driving part 120, the gate driving part 130, the de-multiplexer 440 and the timing control part 470.

The de-multiplexer 440 is disposed between the data driving part 120 and the data lines DL1, DL2, . . . DL6, and the de-multiplexer 440 selectively connects each of the channels CH1, CH2, and CH3 with corresponding one or more data lines of the data lines DL1, DL2, . . . DL6.

According to an embodiment, the de-multiplexer 440 connects one of the channels CH1, CH2, and CH3 with two of the data lines DL1, DL2, . . . DL6. The de-multiplexer 440 includes a first switching element part 450 and a second switching element part 460. The first switching element part 450 includes first switching elements 451, and connects the channels CH1, CH2, and CH3 with the first pixel 411, the third pixel 413, and the fifth pixel 415, respectively. The second switching element part 460 includes second switching elements 461, and connects the channels CH1, CH2, and CH3 with the second pixel 412, the fourth pixel 414, and the sixth pixel 416, respectively.

The first switching element 451 and the second switching element 461 connected with one of the channels CH1 and CH2 are connected with pixels having the same colors. For example, according to an embodiment, the first switching element 451 is connected with the first data line DL1 connected with the first pixel 411, and the second switching element 461 is connected with a fourth data line DL4 connected with the second pixel 412.

The timing control part 470 outputs a seventh turn-on signal TG7 turning on the first switching element 451 of the de-multiplexer 440 to the first switching element 451 and an eighth turn-on signal TG8 turning on the second switching element 461 of the de-multiplexer 440 to the second switching element 461. The seventh turn-on signal TG7 and the eighth turn-on signal TG8 may be de-multiplexer control signals controlling the first switching element 451 and the second switching element 461 of the de-multiplexer 440.

The timing control part 470 changes an activation sequence of the seventh turn-on signal TG7 and the eighth turn-on signal TG8 per N (N is a natural number) frames. For example, the activation sequence of the seventh turn-on signal TG7 and the eighth turn-on signal TG8 may be changed per frame.

Figure 12:
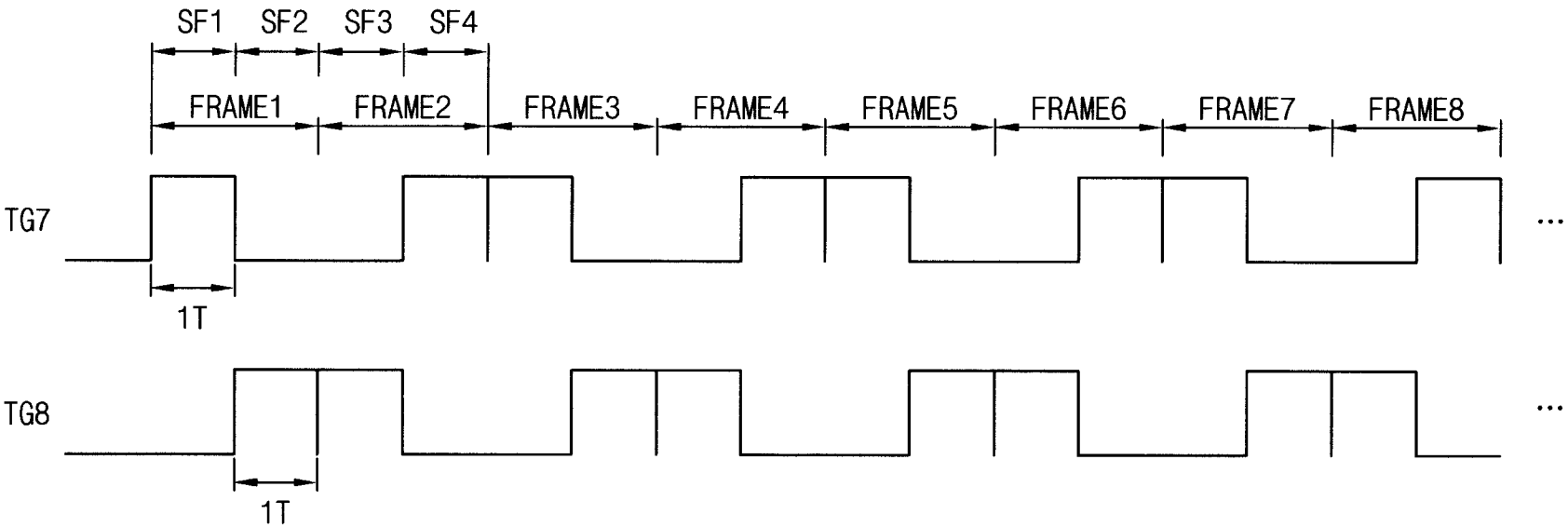
FIG. 12 is a waveform diagram illustrating the seventh turn-on signal and the eighth turn-on signal of FIG. 11.

FIG. 12 is a waveform diagram illustrating the seventh turn-on signal TG7 and the eighth turn-on signal TG8 of FIG. 11.

Referring to FIGS. 11 and 12, the activation sequence of the seventh turn-on signal TG7 and the eighth turn-on signal TG8 is changed per frame.

The first switching element 451 and the second switching element 461 are sequentially turned on by the seventh turn-on signal TG7 and the eighth turn-on signal TG8 during a first frame period FRAME1, and the second switching element 461 and the first switching element 451 are sequentially turned on by the eighth turn-on signal TG8 and the seventh turn-on signal TG7 during a second frame period FRAME2 subsequent to the first frame period FRAME1.

The first switching element 451 is turned on and the first pixel data is applied to the first pixel 411 during a first sub frame period SF1 of the first frame period FRAME1, the second switching element 461 is turned on and the second pixel data is applied to the second pixel 412 during a second sub frame period SF2 subsequent to the first sub frame period SF1 of the first frame period FRAME1, the second switching element 461 is turned on and the second pixel data is applied to the second pixel 412 during a third sub frame period SF3 of the second frame period FRAME2, and the first switching element 451 is turned on and the first pixel data is applied to the first pixel 411 during a fourth sub frame period SF4 subsequent to the third sub frame period of the second frame period FRAME2.

The first switching element 451 and the second switching element 461 are sequentially turned on by the seventh turn-on signal TG7 and the eighth turn-on signal TG8 during a third frame period FRAME3 subsequent to the second frame period FRAME2, and the second switching element 461 and the first switching element 451 are sequentially turned on by the eighth turn-on signal TG8 and the seventh turn-on signal TG7 during a fourth frame period FRAME4 subsequent to the third frame period FRAME3. In the same or substantially the same manner, a driving sequence of the first switching element 451 and the second switching element 461 is changed per frame.

Each of the first switching element 451 and the second switching element 461 is turned on during a half period in a period of the frame. For example, according to an embodiment, the frame may have a frequency of about 120 Hz. Alternatively, the frame may have a frequency of about 60 Hz.

The second switching element 461 is turned on after the first switching element 451 is turned on during the first frame period FRAME1, and thus a first charge rate at which the first pixel 411 is charged with the first pixel data is higher than a second charge rate at which the second pixel 412 is charged with the second pixel data since a first charge time during which the first pixel 411 is charged with the first pixel data is longer than a second charge time during which the second pixel 412 is charged with the second pixel data while a gate signal is applied to a gate line connected with the first pixel 411 and the second pixel 412. Thus, a luminance of the first pixel 411 is higher than a luminance of the second pixel 412.

The first switching element 451 is turned on after the second switching element 461 is turned on during the second frame period FRAME2, and thus a second charge rate at which the second pixel 412 is charged with the second pixel data is higher than a first charge rate at which the first pixel 411 is charged with the first pixel data since a second charge time during which the second pixel 412 is charged with the second pixel data is longer than a first charge time during which the first pixel 411 is charged with the first pixel data while the gate signal is applied to the gate line connected with the first pixel 411 and the second pixel 412. Thus, the luminance of the second pixel 412 is higher than the luminance of the first pixel 411.

The driving sequence of the first switching element 451 and the second switching element 461 is changed per frame, and thus an average of the first charge rate and an average of the second charge rate is substantially the same as each other. Thus, an average of the luminance of the first pixel 411 and an average of the luminance of the second pixel 412 is substantially the same as each other.

Figure 13:
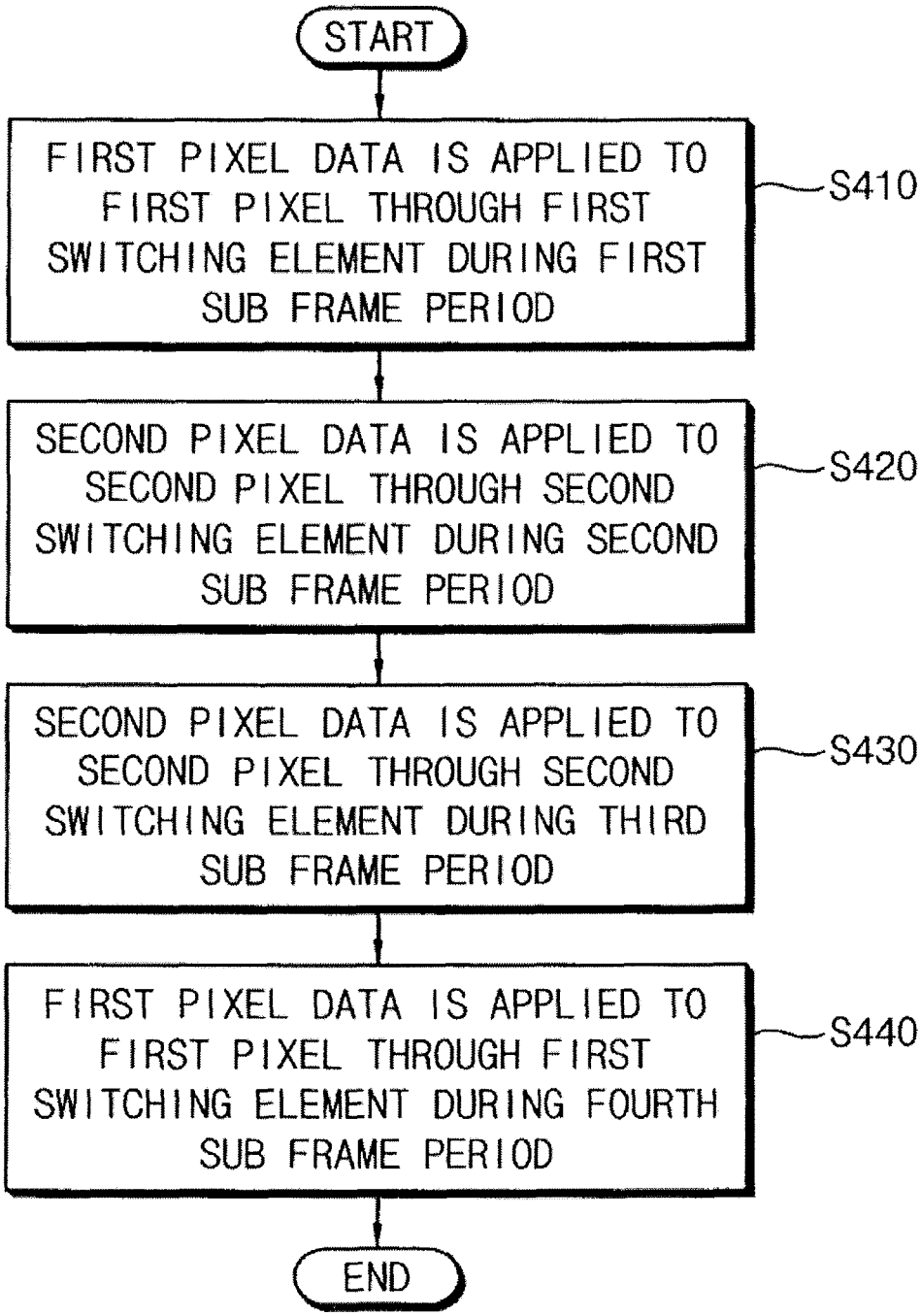
FIG. 13 is a flowchart illustrating a method of a driving a display panel by the display panel driving apparatus of FIG. 11.

FIG. 13 is a flowchart illustrating a method of a driving a display panel by the display panel driving apparatus 401 of FIG. 11.

Referring to FIGS. 11 and 13, the first switching element 451 is turned on and the first pixel data is applied to the first pixel 411 during the first sub frame period SF1 of the first frame period FRAME1 (step S410). The timing control part 470 applies the seventh turn-on signal TG7 to the first switching element 451 during the first sub frame period SF1 of the first frame period FRAME1, and the first pixel data is applied to the first pixel 411 by turning on the first switching element 451.

The second switching element 461 is turned on and the second pixel data is applied to the second pixel 412 during the second sub frame period SF2 of the first frame period FRAME1 (step S420). The timing control part 470 applies the eighth turn-on signal TG8 to the second switching element 461 during the second sub frame period SF2 of the first frame period FRAME1, and the second pixel data is applied to the second pixel 412 by turning on the second switching element 461.

The second switching element 461 is turned on and the second pixel data is applied to the second pixel 412 during the third sub frame period SF3 of the second frame period FRAME2 (step S430). The timing control part 470 applies the eighth turn-on signal TG8 to the second switching element 461 during the third sub frame period SF3 of the second frame period FRAME2, and the second pixel data is applied to the second pixel 412 by turning on the second switching element 461.

The first switching element 451 is turned on and the first pixel data is applied to the first pixel 411 during the fourth sub frame period SF4 of the second frame period FRAME2 (step S440). The timing control part 470 applies the seventh turn-on signal TG7 to the first switching element 451 during the fourth sub frame period SF4 of the second frame period FRAME2, and the first pixel data is applied to the first pixel 411 by turning on the first switching element 451.

The driving sequence of the first switching element 451 and the second switching element 461 is changed per frame, and thus the average of the first charge rate at which the first pixel 411 is charged with the first pixel data and the average of the second charge rate at which the second pixel 412 is charged with the second pixel data is substantially the same as each other. Thus, the average of the luminance of the first pixel 411 and the average of the luminance of the second pixel 412 are substantially the same as each other.

According to an exemplary embodiment, the average of the first charge rate and the average of the second charge rate may be substantially the same as each other since the driving sequence of the first switching element 451 and the second switching element 461 is alternately changed, although the first charge time during which the first pixel 411 is charged with the first pixel data through the first switching element 451 and the first data line DL1 and the second charge time during which the second pixel 412 is charged with the second pixel data through the second switching element 461 and the second data line DL2 are different from each other.

The driving sequence of the first switching element 451 and the second switching element 461 is alternately changed, and thus a change rate of a voltage-current (Vgs-Ids) characteristic of the first switching element 451 is substantially the same as a change rate of a voltage-current (Vgs-Ids) characteristic of the second switching element 461. Thus, a difference between the luminance of the first pixel 411 and the luminance of the second pixel 412 due to a difference between the voltage-current (Vgs-Ids) characteristic of the first switching element 451 and the voltage-current (Vgs-Ids) characteristic of the second switching element 461 may be prevented.

Figure 14:
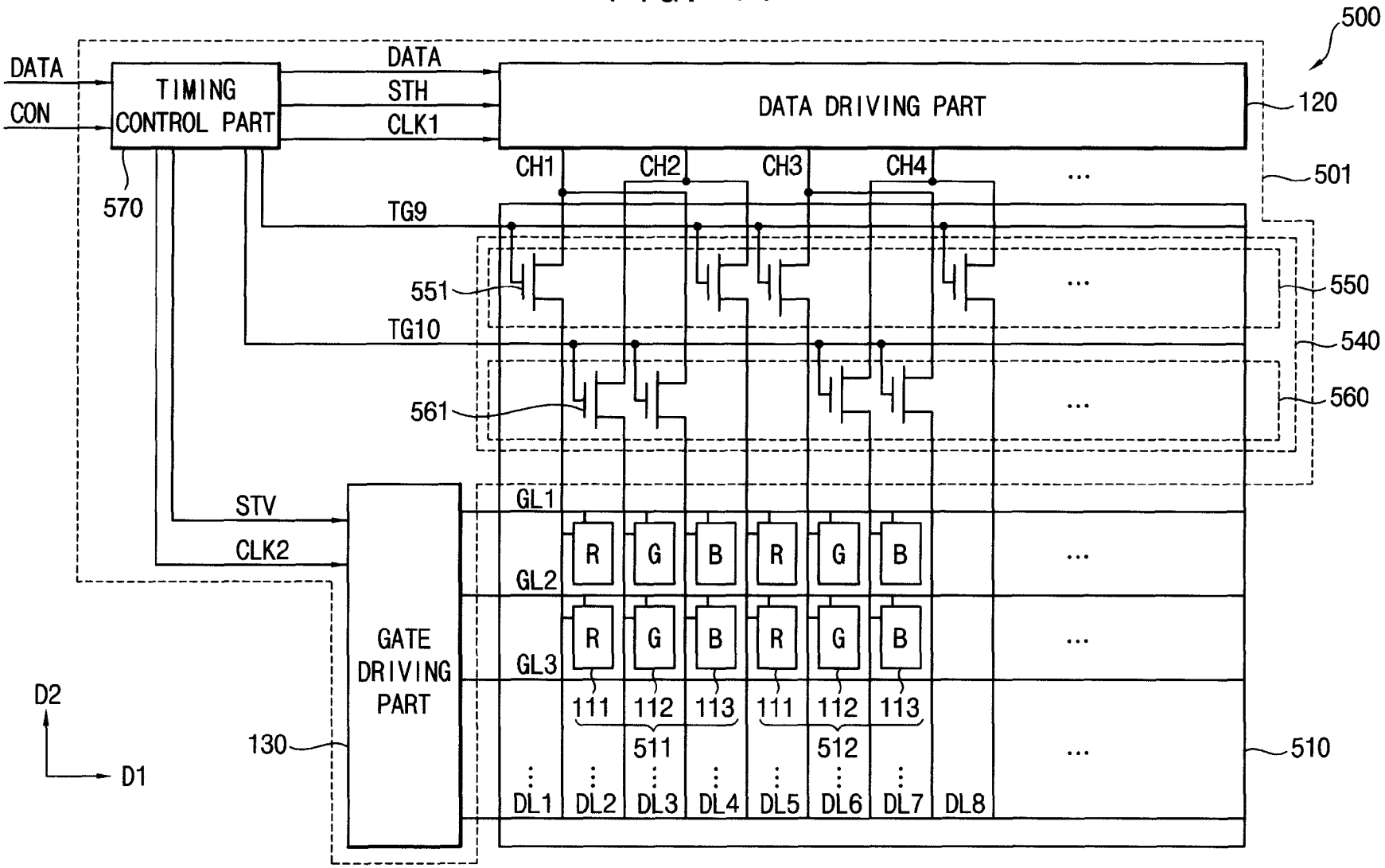
FIG. 14 is a block diagram illustrating a display apparatus according to an exemplary embodiment of the present invention.

FIG. 14 is a block diagram illustrating a display apparatus according to an exemplary embodiment of the present invention.

The display apparatus 500 according to an exemplary embodiment is substantially the same as the display apparatus 100 described in connection with FIG. 1 except for a display panel 510, a display panel driving apparatus 501, a de-multiplexer 540 and a timing control part 570.

Referring to FIG. 14, the display apparatus 500 includes the display panel 510 and the display panel driving apparatus 501.

The display panel 510 includes a first pixel group 511 and a second pixel group 512 sequentially disposed. Each of the first pixel group 511 and the second pixel group 512 includes the first pixel 111, the second pixel 112 and the third pixel 113.

The display panel driving apparatus 501 includes the data driving part 120, the gate driving part 130, the de-multiplexer 540 and the timing control part 570.

The de-multiplexer 540 is disposed between the data driving part 120 and the data lines DL1, DL2, . . . DL6, and the de-multiplexer 540 selectively connects each of the channels CH1 and CH2 with corresponding one or more data lines of the data lines DL1, DL2, . . . DL6. According to an embodiment, the de-multiplexer 540 includes a first switching element part 550 and the second switching element part 560, and connects one of the channels CH1 and CH2 with two of the data lines DL1, DL2, . . . DL6. The first switching element part 550 includes first switching elements 551, and the second switching element part 560 includes second switching elements 561.

The first switching element 551 and the second switching element 561 connected with the same channel of the data driving part 120 may be connected with pixels spaced apart from each other. According to an embodiment, at least one pixel may be disposed between a pixel connected with the first switching element 551 and a pixel connected with the second switching element 561.

For example, according to an embodiment, the first switching element 551 connected with a first channel CH1 may be connected with the first pixel 111 of the first pixel group 511, and the second switching element 561 connected with the first channel CH1 may be connected with the third pixel 113 of the first pixel group 511. The first switching element 551 connected with a second channel CH2 may be connected with the first pixel 111 of the second pixel group 512, and the second switching element 561 connected with the second channel CH2 may be connected with the second pixel 112 of the first pixel group 511.

The timing control part 570 outputs a ninth turn-on signal TG9 turning on the first switching element 551 of the de-multiplexer 540 to the first switching element 551 and a tenth turn-on signal TG10 turning on the second switching element 561 of the de-multiplexer 540 to the second switching element 561.

The ninth turn-on signal TG9 and tenth turn-on signal TG10 may be substantially the same as the first turn-on signal TG1 and the second turn-on signal TG2, respectively, of FIG. 1. When the ninth turn-on signal TG9 and tenth turn-on signal TG10 are substantially the same as the first turn-on signal TG1 and the second turn-on signal TG2, respectively, of FIG. 1, a method of driving a display panel by the display panel driving apparatus 501 may be substantially the same as the method of driving the display panel described above with reference to FIGS. 1 to 4.

Alternatively, the ninth turn-on signal TG9 and tenth turn-on signal TG10 may be substantially the same as the third turn-on signal TG3 and the fourth turn-on signal TG4, respectively, of FIG. 5. When the ninth turn-on signal TG9 and tenth turn-on signal TG10 are substantially the same as the third turn-on signal TG3 and the fourth turn-on signal TG4, respectively, of FIG. 5, the method of driving the display panel by the display panel driving apparatus 501 may be substantially the same as the method of driving the display panel described above with reference to FIGS. 5 to 7.

Alternatively, the ninth turn-on signal TG9 and tenth turn-on signal TG10 may be substantially the same as the fifth turn-on signal TG5 and the sixth turn-on signal TG6, respectively, of FIG. 8, and a first image data applied to the first switching element 551 and a second image data applied to the second switching element 561, respectively, may be substantially the same as the first image data DATA1 applied to the first switching element 151 and the second image data DATA2 applied to the second switching element 151 of FIGS. 8 and 9. When the ninth turn-on signal TG9 and tenth turn-on signal TG10 are substantially the same as the fifth turn-on signal TG5 and the sixth turn-on signal TG6, respectively, of FIG. 8, and the first image data applied to the first switching element 551 and second image data applied to the second switching element 561, respectively, are substantially the same as the first image data DATA1 applied to the first switching element 151 and the second image data DATA2 applied to the second switching element 151 of FIGS. 8 and 9, the method of driving the display panel by the display panel driving apparatus 501 may be substantially the same as the method of driving the display panel described above with reference to FIGS. 8 to 10.

According to an exemplary embodiment, the first switching element 551 and the second switching element 561 connected with the same channel of the data driving part 120 may be connected with the pixels spaced apart from each other. A first charge rate at which the first pixel 111 is charged with the first pixel data and a second charge rate at which the second pixel 112 is charged with the second pixel data may be substantially the same as each other by controlling the ninth turn-on signal TG9 turning on the first switching element 551 and the tenth turn-on signal TG10 turning on the second switching element 561 or by controlling first image data applied to the first switching element 551 and the second image data applied to the second switching element 561.

According to the method of driving the display panel and the display panel driving apparatus for performing the method, a first charge rate at which a first pixel is charged with a first pixel data through a first switching element of a de-multiplexer and a first data line, and a second charge rate at which a second pixel is charged with a second pixel data through a second switching element of the de-multiplexer and a second data line may be substantially the same as each other. Therefore, a luminance of the first pixel and a luminance of the second pixel may be substantially the same as each other, and thus the display quality of the display apparatus may be increased.

The foregoing is illustrative of the embodiments of the present invention and is not to be construed as limiting thereof. Although a few exemplary embodiments of the present invention have been described, those skilled in the art will readily appreciate that many modifications are possible in the exemplary embodiments. Accordingly, all such modifications are intended to be included within the scope of the embodiments of the present invention as defined in the claims.

What is claimed is:

1. A method of driving a display panel, the method comprising:

applying first pixel data to a first pixel through a first switching element during a first sub frame period, wherein the first pixel is connected to a first data line of the display panel, a first end of the first switching element is connected to a data channel of a data driving part and a second other end of the first switching element is connected to the first data line; and applying second pixel data having a voltage level higher than a voltage level of the first pixel data to a second pixel through a second switching element during a second sub frame period, wherein the second pixel is connected to a second data line of the display panel, a first end of the second switching element is connected to the data channel and a second other end of the second switching element is connected to the second data line, wherein applying the first pixel data includes applying a first turn-on signal to the first switching element, and applying the second pixel data includes applying a second turn-on signal having a level higher than a level of the first turn-on signal to the second switching element.

2. The method of claim 1, wherein the first pixel and the second pixel respectively have colors different from each other.

3. The method of claim 1, wherein the first pixel and the second pixel have substantially the same color.

4. A method of driving a display panel, the method comprising:

applying first pixel data to a first pixel through a first switching element during a first sub frame period of a first frame period, wherein the first pixel is connected to a first data line of the display panel, a first end of the first switching element is connected to a data channel of a data driving part and a second other end of the first switching element is connected to the first data line;

applying second pixel data to a second pixel through a second switching element during a second sub frame period of the first frame period that occurs after the first sub frame period, wherein the second pixel is connected to a second data line of the display panel, a first end of the second switching element is connected to the data channel and a second other end of the second switching element is connected to the second data line;

applying the second pixel data to the second pixel through the second switching element during a third sub frame period of a second frame period subsequent to the first frame period; and applying the first pixel data to the first pixel through the first switching element during a fourth sub frame period of the second frame period that occurs after the third sub frame period.

5. The method of claim 4, wherein a turn-on sequence of the first switching element and the second switching element is changed per N frames, where N is a natural number.

6. The method of claim 5, wherein at least one of the first switching element or the second switching element is turned on per half period of the frame.

7. The method of claim 4, wherein the first pixel and the second pixel have substantially the same color.

8. A display panel driving apparatus comprising:

a first switching element configured to apply first pixel data to a first pixel connected to a first data line of a display panel during a first sub frame period, wherein a first end of the first switching element is connected to a data channel of a data driving part and a second other end of the first switching element is connected to the first data line;

a second switching element configured to apply second pixel data having a voltage level higher than a voltage level of the first pixel data to a second pixel connected to a second data line of the display panel during a second sub frame period, wherein a first end of the second switching element is connected to the data channel and a second other end of the second switching element is connected to the second data line; and a timing control part configured to apply a first turn-on signal to the first switching element and a second turn-on signal to the second switching element, the second turn-on signal having a level higher than a level of the first turn-on signal.

9. The display panel driving apparatus of claim 8, wherein the first pixel and the second pixel respectively have colors different from each other.

10. The display panel driving apparatus of claim 8, wherein the first pixel and the second pixel have substantially the same color.

11. A display panel driving apparatus comprising:

a first switching element configured to apply first pixel data to a first pixel connected to a first data line of a display panel during a first sub frame period of a first frame period and, a fourth sub frame period of a second frame period subsequent to the first frame period and, wherein a first end of the first switching element is connected to a data channel of a data driving part and a second other end of the first switching element is connected to the first data line; and a second switching element configured to apply second pixel data to a second pixel connected with a second data line of the display panel during a second sub frame period of the first frame period and a third sub frame period of the second frame period, wherein a first end of the second switching element is connected to the data channel and a second other end of the second switching element is connected to the second data line, and wherein the first frame period includes the first sub frame period followed by the second sub frame period, and the second frame period includes the third sub frame period followed by the fourth sub frame period.

12. The display panel driving apparatus of claim 11, wherein a turn-on sequence of the first switching element and the second switching element is changed per N frames, wherein N is a natural number.

13. The display panel driving apparatus of claim 12, wherein at least one of the first switching element or the second switching element is turned on per half period of the frame.

14. The display panel driving apparatus of claim 11, wherein the first pixel and the second pixel have substantially the same color.

15. A method of driving a display panel, the method comprising:

charging a first pixel with a first pixel data voltage via a data channel in response to a first turn-on voltage applied to a first switching element during a first sub frame period, wherein the first switching element is connected between the data channel and a first data line;

charging a second pixel with a second pixel data voltage via the data channel in response to a second turn-on voltage applied to a second switching element during a second sub frame period, wherein the second switching element is connected between the data channel and a second data line; and adjusting at least one of a first charging rate at which the first pixel is charged with the first pixel data voltage or a second charging rate at which the second pixel is charged with the second pixel data voltage so that the first charging rate is substantially the same as the second charging rate, wherein the adjusting comprises allowing a level of the second turn-on voltage to be higher than a level of the first turn-on voltage.

16. A method of driving a display panel, the method comprising:

charging a first pixel with a first pixel data voltage via a data channel in response to a first turn-on voltage applied to a first switching element during a first sub frame period, wherein the first switching element is connected between the data channel and a first data line;

charging a second pixel with a second pixel data voltage via the data channel in response to a second turn-on voltage applied to a second switching element during a second sub frame period, wherein the second switching element is connected between the data channel and a second data line; and adjusting at least one of a first charging rate at which the first pixel is charged with the first pixel data voltage or a second charging rate at which the second pixel is charged with the second pixel data voltage so that the first charging rate is substantially the same as the second charging rate, wherein adjusting at least one of the first charging rate or the second charging rate includes allowing a duty ratio of the second turn-on voltage to be larger than a duty ratio of the first turn-on voltage.

* * * * *